US008342718B2

(12) United States Patent
Kikoski

(10) Patent No.: US 8,342,718 B2
(45) Date of Patent: Jan. 1, 2013

(54) LIGHTING FIXTURES HAVING ILLUMINATED CRYSTAL PANELS AND METHODS FOR PROVIDING ILLUMINATION

(75) Inventor: Andre B. Kikoski, New York, NY (US)

(73) Assignee: Schonbek Worldwide Lighting Inc., Plattsburgh, NY (US)

( * ) Notice: Subject to any disclaimer, the term of this patent is extended or adjusted under 35 U.S.C. 154(b) by 135 days.

(21) Appl. No.: 13/085,062

(22) Filed: Apr. 12, 2011

(65) Prior Publication Data

US 2012/0257394 A1 Oct. 11, 2012

Related U.S. Application Data

(60) Provisional application No. 61/474,229, filed on Apr. 11, 2011.

(51) Int. Cl.
*F21V 3/00* (2006.01)

(52) U.S. Cl. ..... 362/311.01; 362/311.06; 362/326; 362/29; 362/30

(58) Field of Classification Search ..... 362/311.01, 362/311, 29, 30, 326
See application file for complete search history.

(56) References Cited

U.S. PATENT DOCUMENTS 5,233,680 A * 8/1993 Fussell ..... 392/390
6,210,022 B1 * 4/2001 Howard ..... 362/235
D518,227 S * 3/2006 Schonbek et al. ..... D26/154
D518,228 S * 3/2006 Schonbek et al. ..... D26/154
2005/0157502 A1 * 7/2005 Bayer et al. ..... 362/326

OTHER PUBLICATIONS

Frost Light Beam, designed by Vincent Van Duysen, presented at the 2010 Milan Furniture Fair (Apr. 14-19, 2010), printout available online on Apr. 29, 2011, at http://www.ilovebelgium.be/blog/vincent-van-duysen-at-milan-2010-furniture-fair, 6-pages.

Dead or Alive crystal skulls, designed by Fabien Baron, printout available online at http://www.unicahome.com/products/pdf/37111/deadoralivespeclsweb.pdf,1-page, 2005.

Five Untitled Pieces, designed by Donald Judd, printout available online on Apr. 29, 2011, at http://juddconference.posterous.com/looking-at-donald-judd, 5-pages, pieces dated 1969-1971, 1993, 1968, 1976, and 1984.

* cited by examiner

*Primary Examiner* — Ali Alavi
(74) *Attorney, Agent, or Firm* — Heslin Rothenberg Farley & Mesiti P.C.

(57) ABSTRACT

A lighting fixture includes a first support having at least a first surface and a second surface opposite the first surface, a first plurality of ornaments such as crystals attached to the first surface of the first support, and an opaque frame disposed around the first support. The opaque frame has a first opening through which the plurality of ornaments are observable. At least one light source is disposed in the frame for directing light onto at least some of the first plurality of ornaments which light is at least one of refracted and reflected from the first plurality of ornaments.

38 Claims, 4 Drawing Sheets

LIGHTING FIXTURES HAVING ILLUMINATED CRYSTAL PANELS AND METHODS FOR PROVIDING ILLUMINATION

CROSS-REFERENCE TO RELATED APPLICATION

This application claims the benefit of U.S. Provisional Application No. 61/474,229, filed Apr. 11, 2011, entitled "Lighting Fixtures Having Illuminated Crystal Panels And Methods For Providing Illumination", which is hereby incorporated herein by reference in its entirety.

FIELD OF THE INVENTION

This present invention relates generally to lighting fixtures and methods for providing illumination.

BACKGROUND OF THE INVENTION

Recently, solid state lighting fixtures or LED light fixtures are becoming more popular. One such LED fixture generally includes a LED module having a plurality of LEDs attached thereto for directing light inwardly toward an edge of an optical panel or light guide. A frame surrounds the optical panel and LED module, and includes on opening from which light emitted into the end of the panel is emitted from a first surface of the panel and through the opening in the frame.

Frost by Vincent Van Duysen is a light beam encrusted with crystals. The light beam can be supported on a table or suspended from above. The entire surface of the light beam includes a "crust" of randomly assorted, different sized crystals set into resin. Sandwiched between the crystal exteriors is a thin glass panel which gives the beams their structure and rigidity while also acting as a vehicle for the LED lighting within.

There is a need for further lighting fixtures and methods for providing illumination.

SUMMARY OF THE INVENTION

In a first aspect, the present invention provides a lighting fixture which includes a first support having at least a first surface and a second surface opposite the first surface, a first plurality of ornaments attached to the first surface of the first support, and an opaque frame disposed around the first support. The opaque frame has a first opening through which the plurality of ornaments are observable. At least one light source is disposed in the frame for directing light onto at least some of the first plurality of ornaments which light is at least one of refracted and reflected from the first plurality of ornaments.

In a second aspect, the present invention provides the lighting fixture above and further includes a second support having at least a first surface and a second surface opposite the first surface, a second plurality of ornaments attached to the second surface of the second support, and the opaque frame disposed around the second support. The opaque frame has a second opening through which the second plurality of ornaments are observable, and wherein the first opening faces the second opening.

In a third aspect, the present invention provides the lighting fixture above and further includes a third support having at least a first surface and a second surface, a third plurality of ornaments attached to the second surface of the third support, and the opaque frame disposed around the third support. The opaque frame has a third opening through which the third plurality of ornaments are observable. The first opening faces a first direction and the third opening faces a third direction, and wherein the frame is disposed between the first opening and the third opening.

In a fourth aspect, the present invention provides a method for providing illumination. The method includes emitting light from a plurality of ornaments attached to a support disposed in a first opening of an opaque frame disposed around a first support.

BRIEF DESCRIPTION OF THE DRAWINGS

The subject matter which is regarded as the invention is particularly pointed out and distinctly claimed in the concluding portion of the specification. The invention, however, may best be understood by reference to the following detailed description of various embodiments and the accompanying drawings in which:

DETAILED DESCRIPTION OF THE INVENTION

Figure 1:
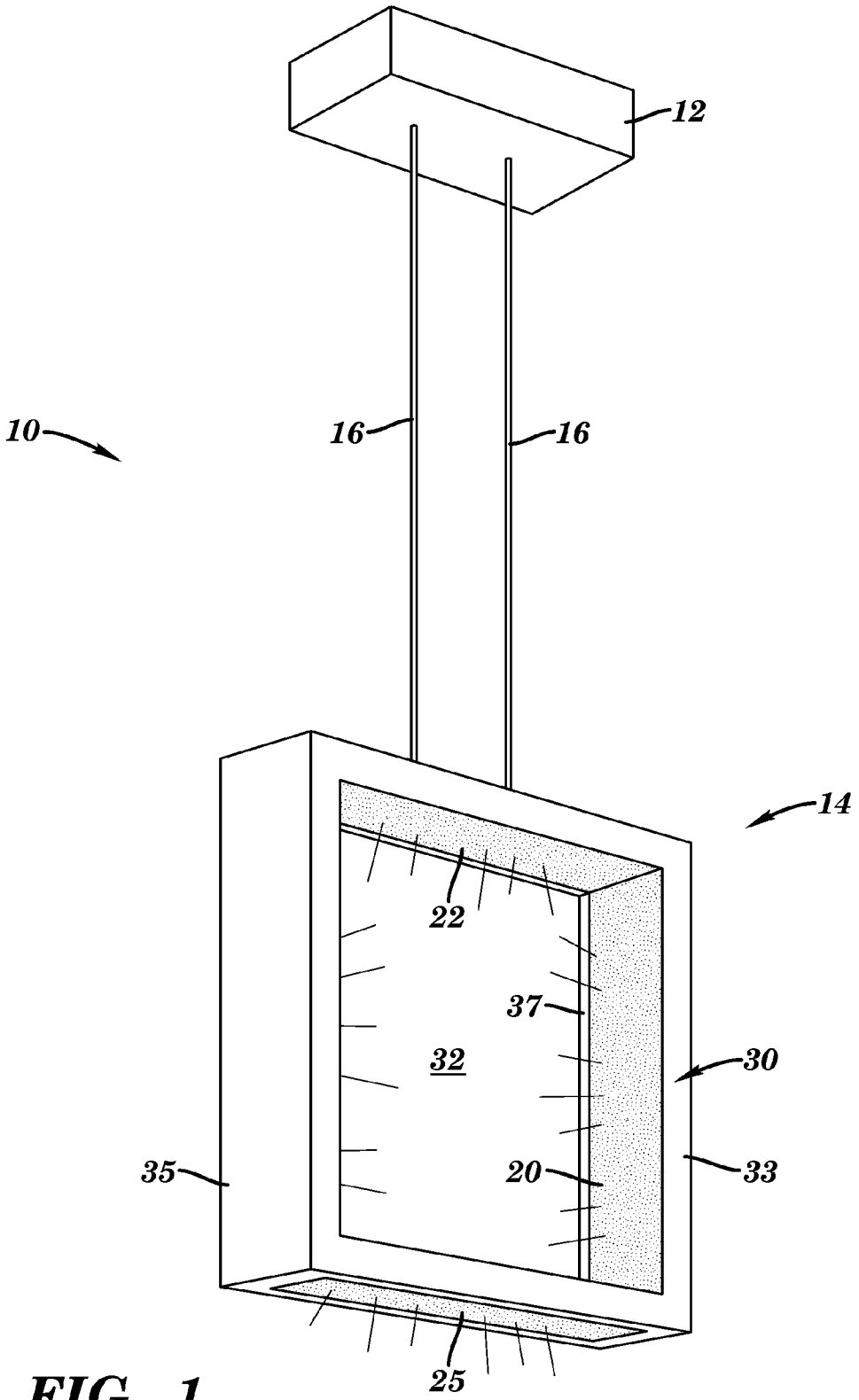
FIG. 1 is a perspective view of one embodiment of a lighting fixture in accordance with an aspect of the present invention.

FIG. 1 illustrates one embodiment of a lighting pendent 10 in accordance with an aspect the present invention. Lighting pendent 10 generally comprises a ceiling mount 12, a light fixture 14, and a plurality of wires 16 for supporting the light fixture from the ceiling mount. The lighting pendent is operably connected to an electrical supply.

Lighting fixture 14 generally includes a frame 30 having one or more illuminated portions 20, 22, and 25 in accordance with an aspect to the present invention as described in greater detail below.

In this illustrated embodiment, frame 30 defines a structure having a vacant center 32. The structure may extend continuously around the vacant center. As shown in FIG. 1, the structure may be a generally square-shaped hollow box structure.

Frame 30 may be formed from an opaque or non-translucent material having a peripherally-extending front surface 33, a peripherally-extending outer surface 35, a peripherally-extending back surface (not shown in FIG. 1), and an inside surface 37.

Inside surface 37 of frame 30 may include one or more openings to expose illuminated portion 20 and 22 which emit light inwardly toward vacant center 32. While illuminated portion 20 is illustrated on the inner right side of frame 30, another illuminated portion (not shown in FIG. 1) may be disposed on the inner left side of frame 30. While illuminated portion 22 is illustrated on the inner upper side of frame 30, another illuminated portion (not shown in FIG. 1) may be disposed on the inner lower side of frame 30. The lower surface portion of outside surface 35 of frame 30 may include illuminated portion 25 for emitting light outwardly from the structure. Other portions of outer surface 35 may also be provided with illuminated portions. While the illuminated portions extend generally along the length of a side of the structure defined by the frame, it will be appreciated that the illuminated portions need not extend along the entire length of the side of the structure, and may have other configurations.

With reference still to FIG. 1, the illuminated portions comprise a plurality of ornaments 70 such as crystals which are observable and which refract, emit, and/or reflect light, for example, light directed onto the ornaments or crystals. According to aspects of the present invention, the ornaments or crystals may be any ornament that may be mounted to a surface, for example, an opaque, translucent, or transparent ornament. The ornaments may comprise a plastic, stone, metal, glass material, or may be gem stones, such as, rubies or sapphires. The translucent or transparent ornament may be comprise a tint or color, for example, blue or red, but may typically be substantially clear. In one aspect, the crystals or ornaments may be crystals provided by D. Swarovski Co. of Wattens, Austria, or their equivalent, and may be referred to as "job lot" crystals.

Figure 2:
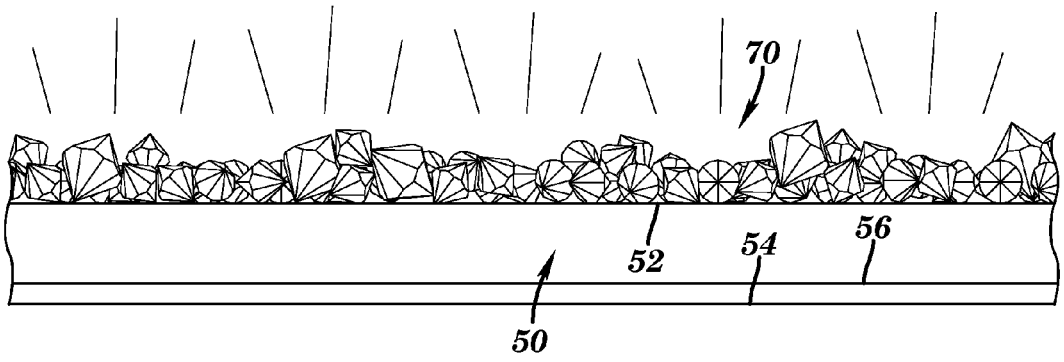
FIG. 2 is an enlarged cross-sectional view through the illuminated portion of the lighting fixture of FIG. 1.

FIG. 2 illustrates a cross-section through a portion of the illuminated portions shown in FIG. 1. In this illustrated embodiment, the illuminated portions may include a first support 50 having at least a first surface 52 and a second surface 54, for example, opposite first surface 52. The support between first surface 52 and an edge 56 may be beveled, for example, at an angle of 45-degrees, so that the different illuminated panels may mate tightly at the corners of the square. A plurality of ornaments 70 is attached to first surface 52 of support 50. For example, the plurality of ornaments 70 may be attached to first surface 52 with suitable glue, adhesive, or other bonding agent. For example, to attach the plurality of ornaments, a thin layer of glue is applied to the surface of the support, and the ornaments are then applied to the glue, for example, poured thereon. Some places may have one layer of ornaments, some may have two or more layers, depending on how the ornaments attach. Desirably, the adhesive or other bonding agent does not inhibit emission of light.

Figure 3:
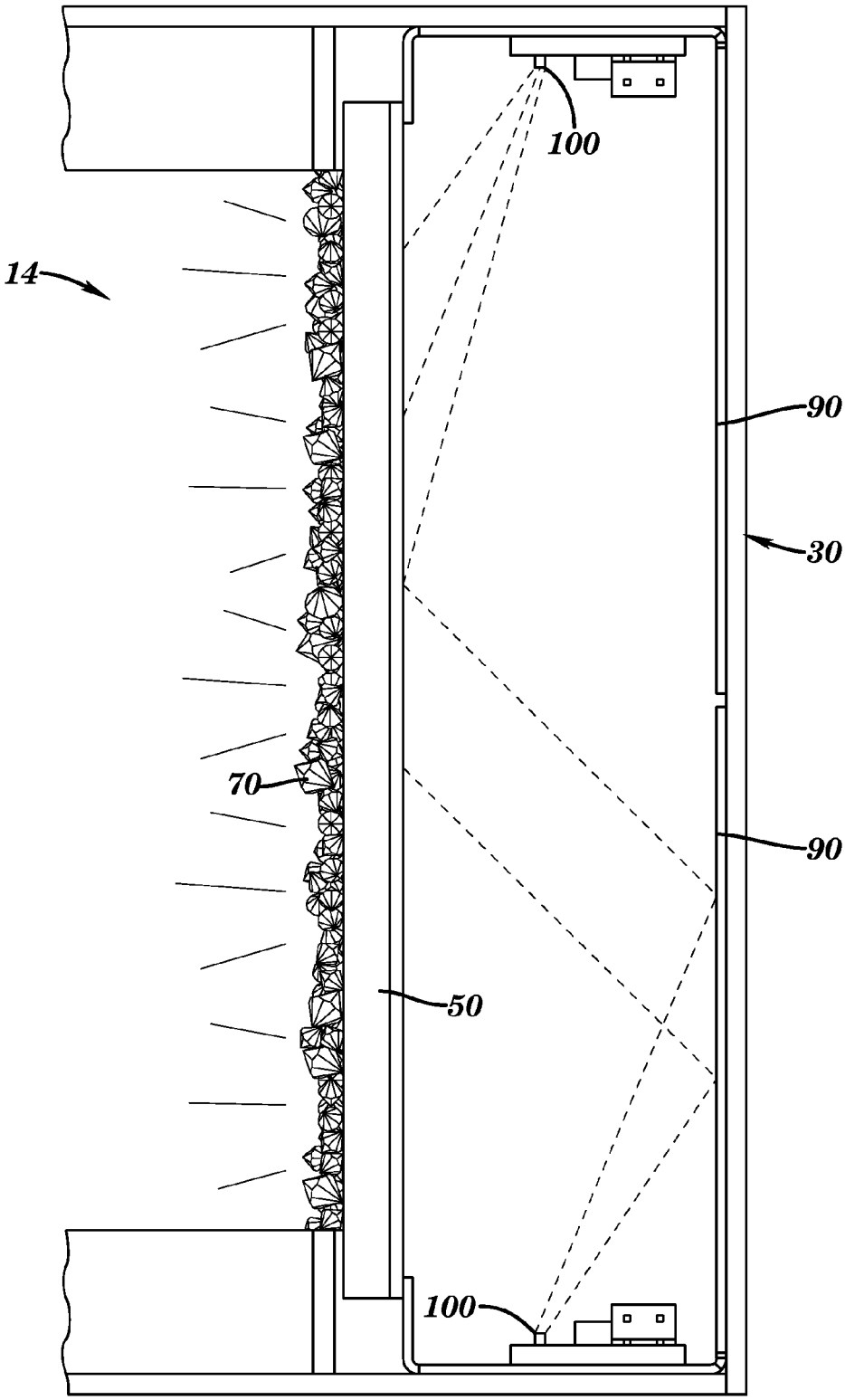
FIG. 3 is a cross-sectional view of a portion of the lighting fixture of FIG. 1 illustrating at least one light source.
Figure 4:
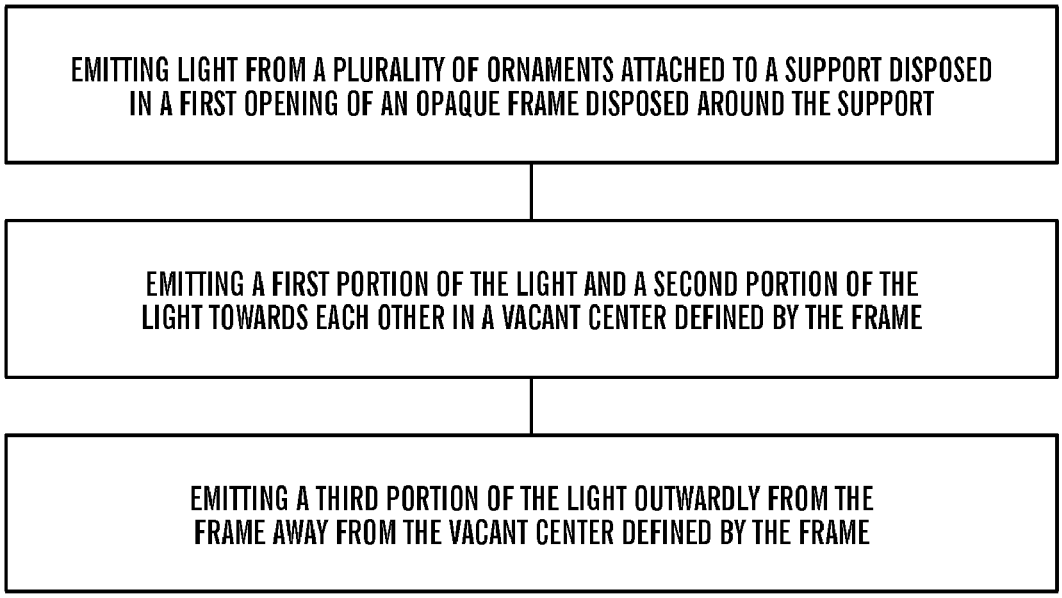
FIG. 4 is a flowchart illustrating a method for providing illumination in accordance with an aspect of the present invention.

FIG. 3 is a cross-sectional view of a portion of lighting fixture 14 of FIG. 1. For example, lighting fixture 14 may include an LED 100 or a plurality of LEDs disposed in frame 30 behind support 50. Disposed in frame 30 may be a reflector 90 for reflecting light, for example, which is initially emitted from the LED away from support 50, but which is reflected off reflecting material 90 toward support 50.

The support may be a planar support such as a plastic material or glass material. The planar support may be planar, flat, curved, or have other suitable configurations, and combinations thereof. Desirably, the support comprises a clear or transparent material. The illuminated panels may be rectangular, as shown in FIG. 1, or may have other suitable configurations. In addition, other light sources may be suitably employed. For example, incandescent or florescent light sources may be employed.

Though in aspects of the invention the ornaments 70 may of any available size, for example, from about 1 mm to about 100 mm in width, the plurality of ornaments 70 may typically comprise an average width or diameter less than 5 millimeters, less than 3 millimeters, or less than 1 millimeter, and may range between 2 and 3 millimeters, between 1 and 5 millimeters, between 3 and 5 millimeters, or between 1 and 3 millimeters. It will be apprenticed that other size ornaments may be suitably employed as well. The ornaments or crystals may be double-pointed stones, tetrahedrons, polyhedrons, or have other faceted configurations. The support may be formed from glass and have a thickness of about 3 to 4 millimeters.

The shape of the light fixture may be generally a square hollow box-like structure having a vacant center therein as shown in FIG. 1, or may have any suitable configuration such as circular or ring configuration, oval, triangular, rectangular, polygonal configurations, and combinations thereof having a vacant center therein. While the structure shown in FIG. 1 forming the lighting fixture continuously extends around the vacant center, the structure need not extend entirely around the vacant center, and may include one or more openings in the structure around the vacant center. In addition, the light fixture may include a portion of the structure shown in FIG. 1 with just a frame on one side and an illuminated panel on the other side, for example, having the one of the vertical sides, or one of the top and bottom sides. While the frame is opaque or non-translucent in FIG. 1, the entire frame need not be opaque or non-translucent.

Thus, while various embodiments of the present invention have been illustrated and described, it will be appreciated to those skilled in the art that many changes and modifications may be made thereunto without departing from the spirit and scope of the invention.

The invention claimed is:

1. A lighting fixture comprising:

a first support having at least a first surface and a second surface opposite the first surface;

a first plurality of ornaments attached to said first surface of said first support;

an opaque frame disposed around said first support, said opaque frame having a first opening through which said plurality of ornaments are observable; and at least one light source disposed in said frame for directing light onto at least some of said first plurality of ornaments which light is at least one of refracted and reflected from said first plurality of ornaments.

2. The lighting fixture of claim 1 wherein said frame defines a structure defining a vacant center.

3. The lighting fixture of claim 2 wherein said first opening in the frame is disposed inwardly towards said vacant center of said structure.

4. The lighting fixture of claim 2 wherein said first opening in the frame is disposed outwardly from said structure away from said vacant center of said structure.

5. The lighting fixture of claim 2 wherein said frame defines a structure which extends continuously around said vacant center.

6. The lighting fixture of claim 2 wherein said frame defines a generally hollow square-shaped structure defining said vacant center.

7. The lighting fixture of claim 1 wherein said light source comprises at least one light emitting diode.

8. The lighting fixture of claim 1 wherein said first support comprises a planar support.

9. The lighting fixture of claim 1 wherein said first support comprises a translucent material.

10. The lighting fixture of claim 1 wherein said plurality of ornaments comprise a plurality of crystals having an average diameter between about 2 and 3 millimeters.

11. The lighting fixture of claim 1 further comprising:

a second support having at least a first surface and a second surface opposite the first surface;

a second plurality of ornaments attached to said second surface of said second support;

said opaque frame disposed around said second support, said opaque frame having a second opening through which said second plurality of ornaments are observable, and wherein said first opening faces said second opening; and said at least one light source disposed in said frame is operable for directing light onto at least some of said second plurality of ornaments which light is at least one of refracted and reflected from said second plurality of ornaments.

12. The lighting fixture of claim 11 wherein said frame defines a structure defining a vacant center.

13. The lighting fixture of claim 12 wherein said first opening and said second opening in the frame is disposed inwardly towards said vacant center of said structure.

14. The lighting fixture of claim 12 wherein said frame defines a structure which extends continuously around said vacant center.

15. The lighting fixture of claim 12 wherein said frame defines a generally hollow square-shaped structure defining said vacant center.

16. The lighting fixture of claim 11 wherein said light source comprises at least one light emitting diode.

17. The lighting fixture of claim 11 wherein said first support comprises a planar support.

18. The lighting fixture of claim 11 wherein said first support comprises a translucent material.

19. The lighting fixture of claim 11 wherein said plurality of ornaments comprise a plurality of crystals having an average diameter between about 2 and 3 millimeters.

20. The lighting fixture of claim 1 further comprising:

a third support having at least a first surface and a second surface opposite the first surface;

a third plurality of ornaments attached to said second surface of said third support;

said opaque frame disposed around said third support, said opaque frame having a third opening through which said third plurality of ornaments are observable, said first opening faces a first direction and said third opening faces a third direction, and wherein said frame is disposed between said first opening and said third opening; and said at least one light source disposed in said frame is operable for directing light onto at least some of said third plurality of ornaments which light is at least one of refracted and reflected from said third plurality of ornaments away from said frame.

21. The lighting fixture of claim 20 wherein said frame defines a structure defining a vacant center.

22. The lighting fixture of claim 21 wherein said first opening in the frame is disposed inwardly towards said vacant center of said structure, and said third opening in the frame is disposed outwardly from said structure away from said vacant center of said structure.

23. The lighting fixture of claim 21 wherein said frame defines a structure which extends continuously around said vacant center.

24. The lighting fixture of claim 21 wherein said frame defines a generally hollow square-shaped structure defining said vacant center.

25. The lighting fixture of claim 20 wherein said light source comprises at least one light emitting diode.

26. The lighting fixture of claim 20 wherein said first support comprises a planar support.

27. The lighting fixture of claim 20 wherein said plurality of ornaments comprise a plurality of crystals having an average diameter between about 2 and 3 millimeters.

28. A method for providing illumination, the method comprising:

emitting light from a plurality of ornaments attached to a support disposed in a first opening of an opaque frame disposed around the support.

29. The method of claim 28 wherein the emitting light comprises emitting light inwardly towards a vacant center defined by the frame.

30. The method of claim 29 wherein the frame defines a structure which extends continuously around the vacant center.

31. The method of claim 29 wherein said frame defines a generally hollow square-shaped structure defining said vacant center.

32. The method of claim 28 wherein the emitting light comprises emitting light outwardly from the frame away from a vacant center defined by the frame.

33. The method of claim 28 wherein the emitting light comprises emitting light a first portion of the light and a second portion of the light towards each other in a vacant center defined by the frame.

34. The method of claim 32 wherein the frame defines a structure which extends continuously around the vacant center.

35. The method of claim 32 wherein said frame defines a generally hollow square-shaped structure defining the vacant center.

36. The method of claim 28 wherein the emitting light comprises emitting light from the plurality of ornaments attached to a planar support disposed in the first opening of the frame disposed around the first support.

37. The method of claim 28 wherein the first support comprises a translucent material.

38. The method of claim 28 wherein the plurality of ornaments comprise a plurality of crystals having an average diameter between about 2 and 3 millimeters.

* * * * *